US009428984B2

(12) United States Patent
Dhuet et al.

(10) Patent No.: US 9,428,984 B2
(45) Date of Patent: Aug. 30, 2016

(54) DRIVE OFF METHOD FROM SUBSEA WELL WITH PIPE RETENTION CAPABILITY

(71) Applicant: BAKER HUGHES INCORPORATED, Houston, TX (US)

(72) Inventors: Herbert P. Dhuet, Richmond, TX (US); Christian F. Bayne, The Woodlands, TX (US); Donald P. Lauderdale, Cypress, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 14/466,519

(22) Filed: Aug. 22, 2014

(65) Prior Publication Data

US 2016/0053565 A1 Feb. 25, 2016

(51) Int. Cl.

| | |
|---|---|
| ***E21B 29/12*** | (2006.01) |
| ***E21B 19/10*** | (2006.01) |
| ***E21B 33/064*** | (2006.01) |
| ***E21B 19/00*** | (2006.01) |
| ***E21B 33/076*** | (2006.01) |
| ***E21B 33/06*** | (2006.01) |

(52) U.S. Cl.
CPC ..... *E21B 33/076* (2013.01); *E21B 33/063* (2013.01)

(58) Field of Classification Search
CPC ..... E21B 29/12; E21B 19/002; E21B 19/10; E21B 33/064
USPC ..... 166/297, 298
See application file for complete search history.

(56) References Cited

U.S. PATENT DOCUMENTS

| | | | | |
|---|---|---|---|---|
| 1,802,565 | A * | 4/1931 | Lacey | 83/461 |
| 4,043,389 | A * | 8/1977 | Cobb | 166/55 |
| 4,240,503 | A | 12/1980 | Holt, Jr. et al. | |
| 4,685,521 | A | 8/1987 | Raulins | |
| 5,676,209 | A | 10/1997 | Reynolds | |
| 7,832,480 | B1 * | 11/2010 | Fanguy | 166/298 |
| 8,657,006 | B2 * | 2/2014 | Mire | 166/298 |
| 2006/0254773 | A1 * | 11/2006 | Schlegelmilch et al. | 166/298 |
| 2012/0217019 | A1 * | 8/2012 | Zediker | E21B 33/063 166/363 |

* cited by examiner

*Primary Examiner* — James G Sayre
(74) *Attorney, Agent, or Firm* — Steve Rosenblatt

(57) ABSTRACT

This invention involves a method of securing pipe (also referred to as a "string of tools") when driving off a subsea well or sealing off a well in onshore applications where there is an emergency by grabbing the pipe before it is cut. A pipe ram then is closed on the pipe before a shear ram is actuated to cut the pipe. In subsea applications, the top of the pipe may then be raised clear of the blowout preventer within a marine riser. A blind ram and annular preventer can then be closed above the remnant of the pipe being retained by the pipe catcher. The pipe above the cut is removed through the marine riser and the marine riser itself is then disconnected. The rig is then driven off the well. If the well is reactivated the steps are reversed but the well is safely secured before the blowout preventer components are opened. The pipe supported by the catcher is independently supported before the catcher is released and the pipe lifted through the riser.

17 Claims, 6 Drawing Sheets

DRIVE OFF METHOD FROM SUBSEA WELL WITH PIPE RETENTION CAPABILITY

FIELD OF THE INVENTION

The field of the invention is deep water well drive off procedures or onshore applications where there is an emergency requiring rapid sealing off the well and more specifically a method that allows the pipe in the well to be retained without being dropped as part of sealing off the well.

BACKGROUND OF THE INVENTION

When deep water rigs experience equipment failure such as loss of power systems there is a need to quickly secure the well and drive the rig off the well. The current procedures when this occurs is to cut and drop the pipe in the hole using the shear rams and then use other blowout preventer components to secure the well before driving off. Many times there is expensive equipment on the pipe or in the well such that the act of dropping the pipe will cause an irretrievable loss of such equipment or at least severe damage if it is even possible to retrieve such equipment if the well is later reactivated.

Rather than dropping the pipe the present invention contemplates a method for capturing and anchoring the pipe as an initial step followed by sequential ram operation that later cuts the pipe and closes an annular preventer. In subsea applications when a rig is on location, this allows the pipe above the cut to be removed along with a marine riser so that the rig can be moved off. The pipe catcher can be of a variety of designs that can hold the pipe below the cut as long as needed. Optionally, at a later time if the well is to be reactivated, tests are performed to make sure that the well can be controlled before preventers and rams are reopened, the cut pipe reconnected before the catcher is released. A spear or overshot can grab the top of the pipe above the catcher before the catcher is released. The pipe can then be raised through the marine riser that has been replaced and repaired as needed. Those skilled in the art will better understand the method of the present invention from a review of the detailed description of the preferred embodiment and the associated drawings while recognizing that the full scope of the invention is to be measured by the appended claims.

SUMMARY OF THE INVENTION

This invention involves a method of securing pipe (also referred to as a "string of tools") when driving off a subsea well or sealing off a well in onshore applications where there is an emergency by grabbing the pipe before it is cut. A pipe ram then is closed on the pipe before a shear ram is actuated to cut the pipe. In subsea applications, the top of the pipe may then be raised clear of the blowout preventer within a marine riser. A blind ram and annular preventer can then be closed above the remnant of the pipe being retained by the pipe catcher. The pipe above the cut is removed through the marine riser and the marine riser itself is then disconnected. The rig is then driven off the well. If the well is reactivated the steps are reversed but the well is safely secured before the blowout preventer components are opened. The pipe supported by the catcher is independently supported before the catcher is released and the pipe lifted through the riser.

DETAILED DESCRIPTION OF THE PREFERRED EMBODIMENT

Figure 1:
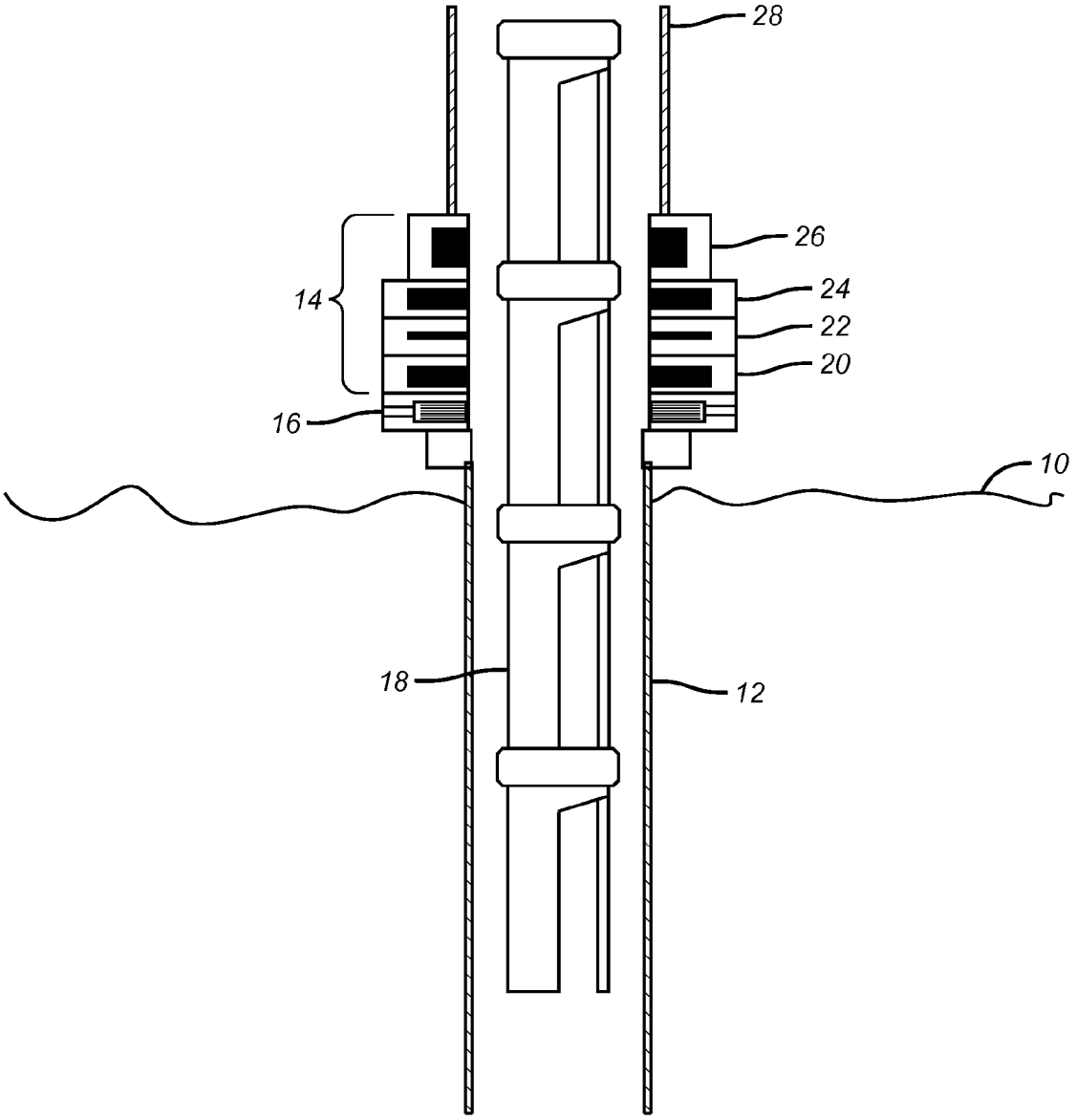
FIG. 1 is a view of running pipe in the hole through a blowout preventer equipped with the pipe catcher.

FIG. 1 shows a seabed 10 having a cased borehole 12 and a blowout preventer assembly 14 mounted to the cased borehole 12 at the seabed 10. Mounted below the blowout preventer assembly 14 is a pipe anchor or catcher 16 that can be selectively remotely operated to grab the pipe 18 that extends through the blowout preventer assembly 14 when needed. The catcher 16 can be a series of circumferentially spaced and articulated slips that can selectively move radially and bite into the pipe 18. The blowout preventer assembly 14 has a pipe ram 20, followed by a shear ram 22 and then a blind ram 24 followed by an annular preventer 26. The marine riser is connected above the annular preventer 26 and extends to the rig above the water that is not shown.

The catcher 16 can as an alternative to simply biting the outer wall of the pipe with wickers mounted on radially movable members that are remotely hydraulically or otherwise actuated can also place slip elements on tapered ramps so that the weight of the pipe wedges the slips harder against the pipe. This design can be provided in mirror image configuration to prevent sudden rapid sting movement out of the borehole 12. The main point is that the pipe 18 is physically supported below the blowout preventer assembly 14 before it is cut by the shear ram 22 and that the pipe 18 can later be retrieved should the well be put back in service.

Figure 2:
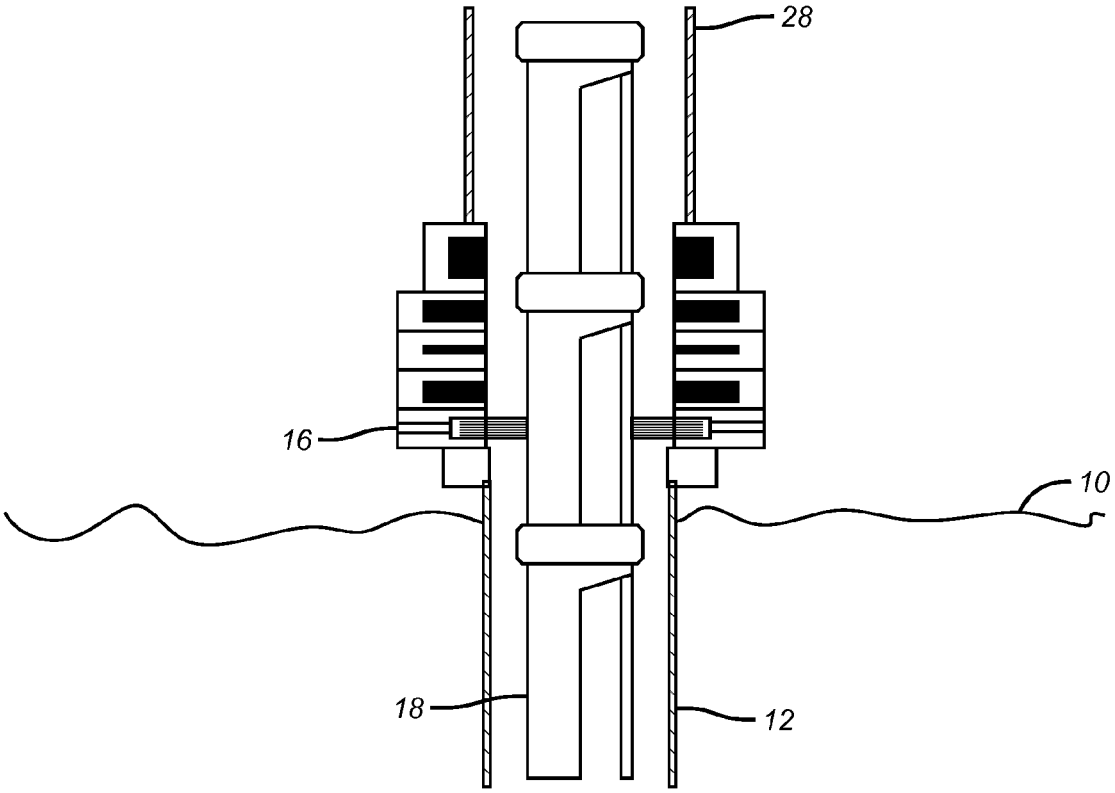
FIG. 2 is the view of FIG. 1 where a need for a drive off arises and the pipe catcher is activated.
Figure 3:
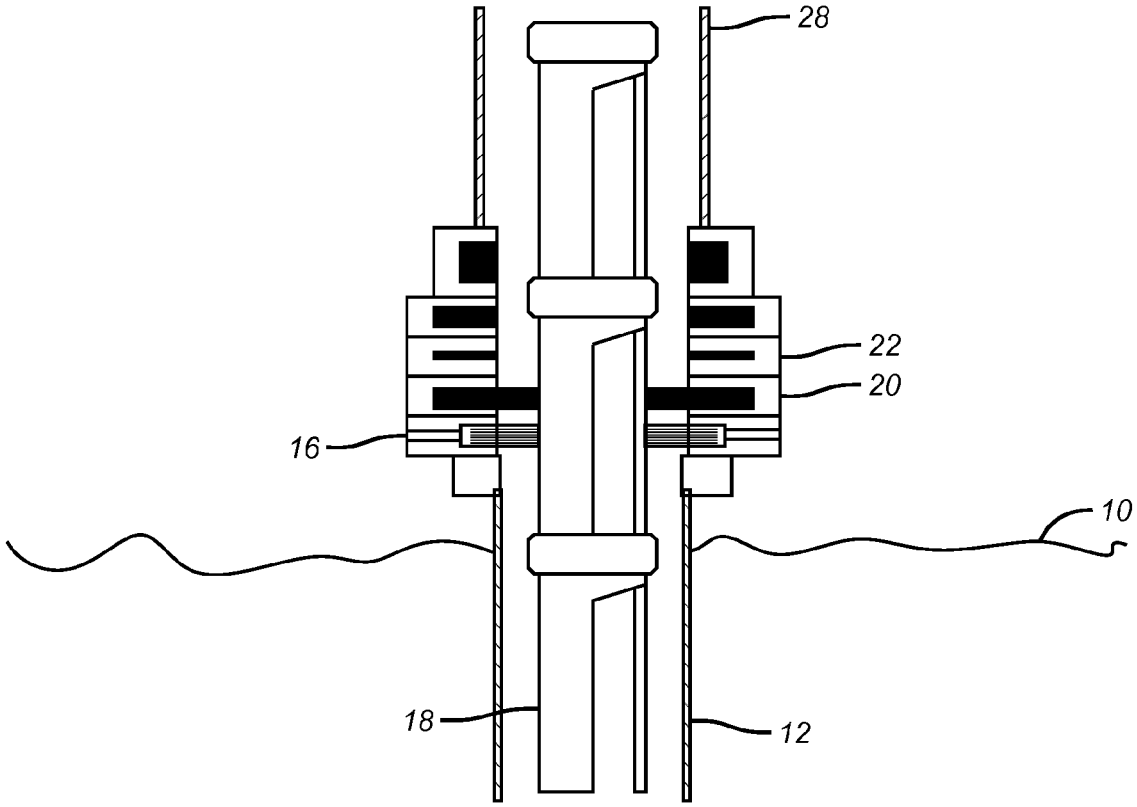
FIG. 3 is the view of FIG. 2 with the pipe rams closed above the pipe catcher.
Figure 4:
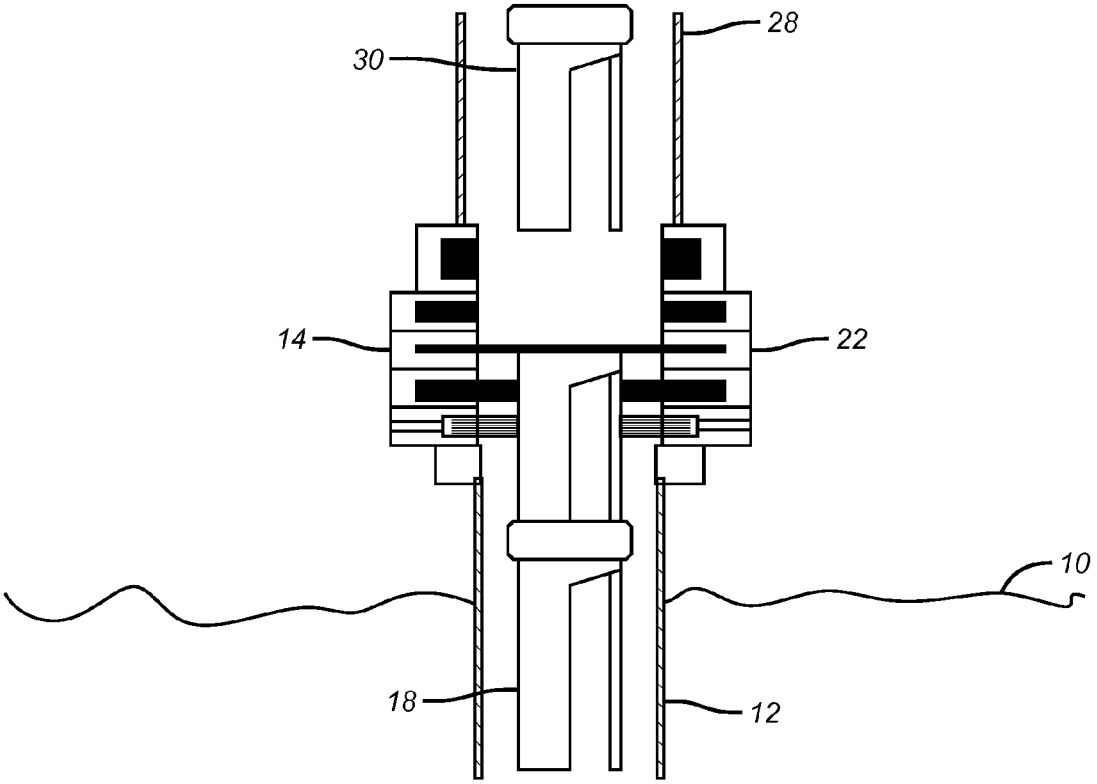
FIG. 4 is the view of FIG. 3 with the shear ram activated and the pipe above the cut moved above the blowout preventer.
Figure 5:
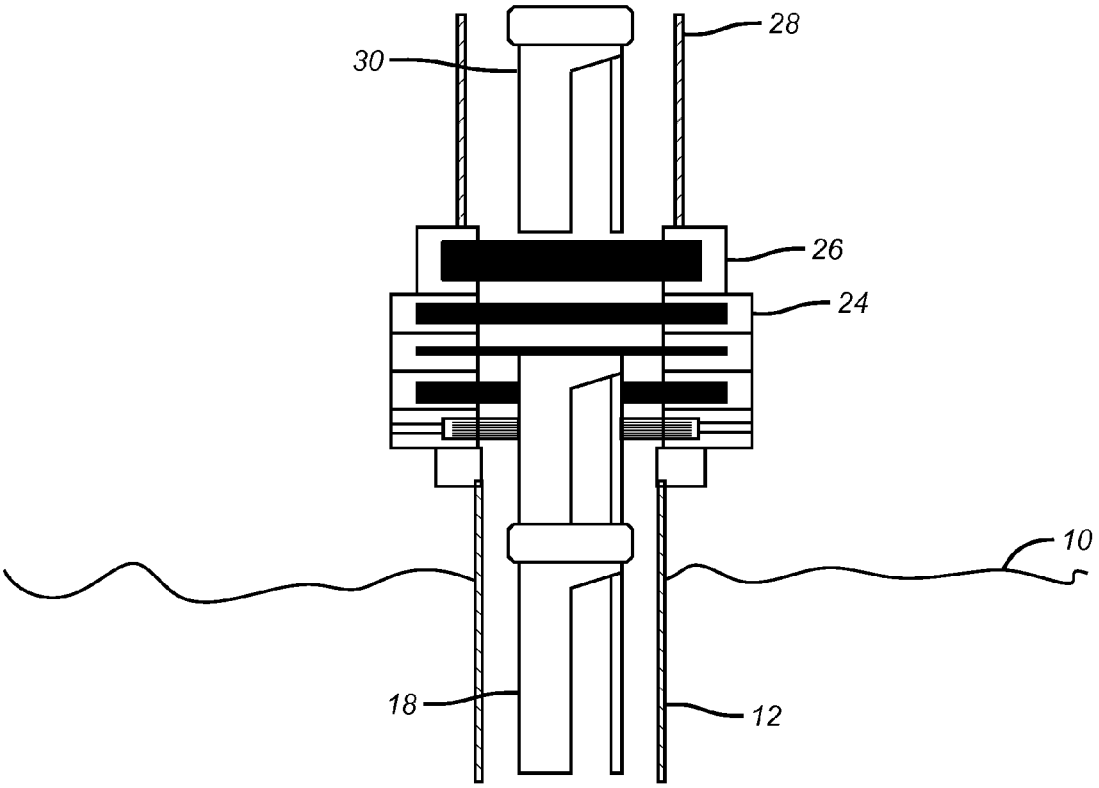
FIG. 5 is the view of FIG. 4 showing the blind ram and annular preventer closed.
Figure 6:
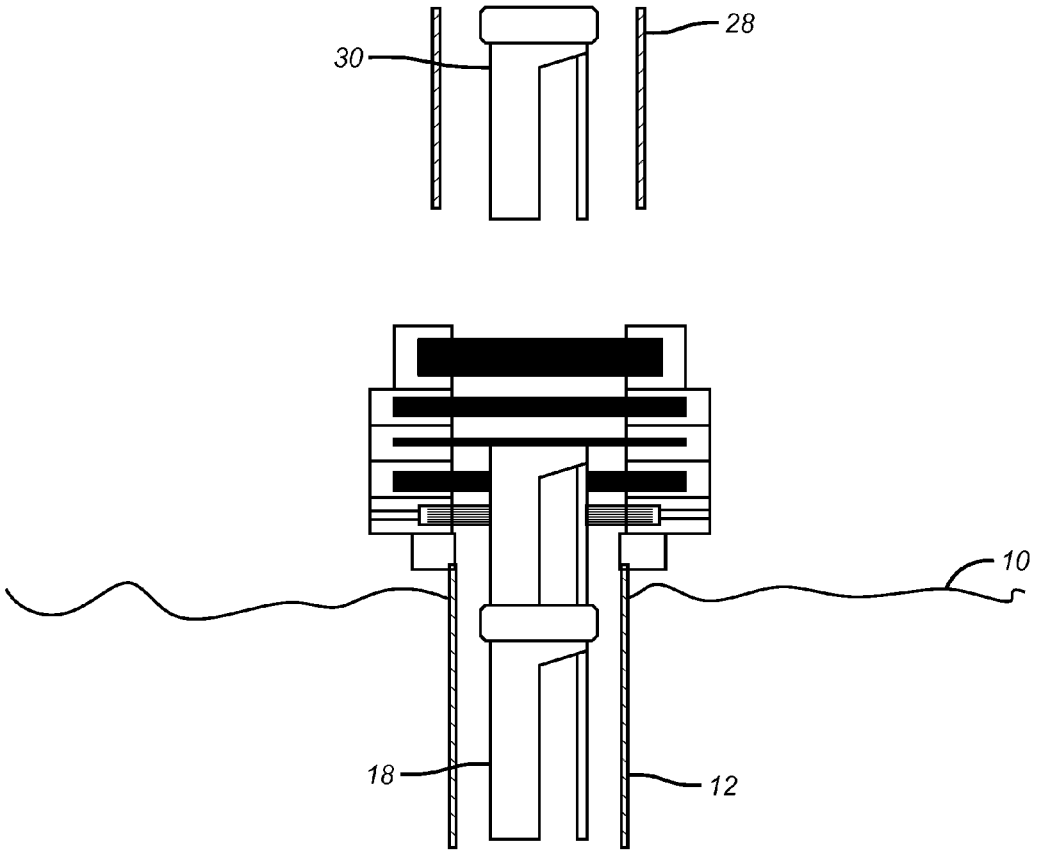
FIG. 6 is the view of FIG. 5 with the marine riser disconnected allowing the rig to move off the well.

FIG. 2 shows the catcher 16 activated to support the pipe 18. FIG. 3 shows the pipe ram 20 activated before the shear ram 22 is activated in FIG. 4. Segment 30 of the pipe 18 is now formed and moved up by the rig to clear the blowout preventer assembly 14. Doing this allows the blind ram 24 and the annular preventer 26 to be operated as shown in FIG. 5. In FIG. 6 a marine riser 28 (which may be used in subsea applications) is disconnected allowing rig (not shown) to move off the borehole 12. The well is now secured. These steps can then be reversed if the borehole 12 is to be put back in service. After the riser 28 is reconnected and the well is re-secured above the blowout preventer assembly 14 a spear or overshot can be run in through the now opened annular preventer 26, blind ram 24 and shear ram 22 to tag and reconnect the pipe 18 still supported by the catcher 16. At this point the catcher 16 is released and the pipe 18 raised through the riser 28 for needed repairs and/or retrieval.

Those skilled in the art will appreciate that with the method of the present invention it is no longer necessary to drop the pipe for a move off the well in an emergency situation. The pipe can be initially supported and then cut and sealed off with the remnant above the cut being pulled clear of the preventer assembly so that another blind ram and an annular preventer can be closed, The marine riser can then be disconnected allowing the rig to move off the well.

The above description is illustrative of the preferred embodiment and many modifications may be made by those skilled in the art without departing from the invention whose scope is to be determined from the literal and equivalent scope of the claims below:

We claim:

1. A method for shutting in a well in an emergency, comprising:

providing a pipe catcher adjacent a blowout preventer;

supporting a pipe with said pipe catcher;

stabilizing said pipe after said supporting by engaging said supported pipe with a pipe ram located adjacent and above said pipe catcher;

cutting said now stabilized pipe with a shear ram located on an opposite side of said pipe ram from said pipe catcher after said stabilizing;

sealing the well above the cut on said pipe.

2. The method of claim 1, comprising:

raising a remnant of said pipe above the cut location clear of the blowout preventer before said sealing the well.

3. The method of claim 1, comprising:

re-entering the blowout preventer to retain the pipe supported by said catcher;

releasing said catcher from said pipe;

raising said pipe through said blowout preventer.

4. The method of claim 1, comprising:

operating a shear ram to cut the pipe after operating said pipe ram.

5. The method of claim 4, comprising:

operating a blind ram over the supported portion of said pipe and after operating said shear ram to close the well over the supported portion of said pipe.

6. The method of claim 5, comprising:

operating an annular preventer above said blind ram after said blind ram is operated.

7. The method of claim 6, wherein:

locating said well subsea.

8. The method of claim 7, wherein:

connecting said well to a rig;

releasing a marine riser from the blowout preventer; and driving the rig off the well.

9. The method of claim 1, comprising:

grabbing said pipe with at least one radially movable slip in said pipe catcher.

10. The method of claim 1, comprising:

retaining said pipe against movement in opposed directions with said pipe catcher.

11. The method of claim 1, comprising:

said well is located subsea.

12. The method of claim 1, comprising:

connecting said well to a rig;

releasing a marine riser from the blowout preventer; and driving the rig off the well.

13. A method for driving a rig off a subsea well, comprising:

supporting a pipe adjacent a blowout preventer with a pipe catcher;

stabilizing the pipe after said supporting with a pipe ram that engages the pipe above said pipe catcher;

cutting the pipe after said stabilizing with a shear ram located on the opposite side of said pipe ram from said pipe catcher;

closing off the well above the cut location;

driving off the well.

14. The method of claim 13, comprising:

providing said pipe catcher with at least one radially extendable slip to accomplish said supporting.

15. The method of claim 14, comprising:

securing the pipe against movement in opposed directions with said pipe catcher.

16. The method of claim 13, comprising:

removing a portion of said pipe above the cut location from the blowout preventer before said closing off.

17. The method of claim 13, comprising:

releasing a marine riser before said driving off.

* * * * *